US005834683A

United States Patent [19]

Benvegnu'

[11] Patent Number: 5,834,683

[45] Date of Patent: Nov. 10, 1998

[54] PROJECTILE HAVING FEATURES OF HIGH DEFORMABILITY ON IMPACT

[75] Inventor: Carlo Benvegnu', Milan, Italy

[73] Assignee: Fiocchi Munizioni S.p.A., Italy

[21] Appl. No.: 905,129

[22] Filed: Aug. 1, 1997

[30] Foreign Application Priority Data

Aug. 7, 1996 [IT] Italy ..... MI96A1719

[51] Int. Cl.[6] ..... F42B 12/00; F42B 12/74

[52] U.S. Cl. ..... 102/516; 102/398; 102/507; 102/529

[58] Field of Search ..... 102/398, 501, 102/506–510, 514–519, 529; 29/1.22, 1.23

[56] References Cited

U.S. PATENT DOCUMENTS

| | | | |
|---|---|---|---|
| 1,017,928 | 2/1912 | Tocik | 102/506 |
| 3,916,795 | 11/1975 | Lemstra | 102/529 |
| 3,972,286 | 8/1976 | Canon | 102/507 |
| 4,015,535 | 4/1977 | Bond, Jr. | 102/516 |
| 4,517,898 | 5/1985 | Davis et al. | 102/514 |
| 4,603,637 | 8/1986 | Snide et al. | 102/529 |
| 4,649,829 | 3/1987 | Bilsbury | 102/516 |
| 4,708,064 | 11/1987 | Bisping et al. | 102/517 |
| 5,394,597 | 3/1995 | White | 102/516 |

FOREIGN PATENT DOCUMENTS

| | | | |
|---|---|---|---|
| 2846998 | 5/1980 | Germany | 102/517 |
| 2011145 | 4/1994 | U.S.S.R. | 102/517 |

*Primary Examiner*—Harold J. Tudor
*Attorney, Agent, or Firm*—Shlesinger, Fitzsimmons & Shlesinger

[57] ABSTRACT

A projectile for firearms has a body (11) consisting of a plurality of disc-shaped elements (14) coaxially fitted in a holding cup (15) forcedly filled therewith.

8 Claims, 1 Drawing Sheet

PROJECTILE HAVING FEATURES OF HIGH DEFORMABILITY ON IMPACT

BACKGROUND OF THE INVENTION

The present invention relates to a projectile provided with a structure enabling achievement of a great reduction in damages and rebounds on impact against an obstacle. This projectile is particularly adapted for use in shooting ranges.

In target-shooting projectiles, intended for use in rifle ranges, the bullet must have features of high deformability so as to avoid serious damages to be caused to structures and objects placed behind or close to the target, should the target be missed. In addition, undesired reboundings of the projectile are to be avoided. For the purpose, projectiles made of lead have been used for a long time, as the malleability of them enables the kinetic energy transmitted to the obstacles on impact to be greatly reduced.

However, use of lead projectiles at circumscribed areas, such as rifle ranges, involves accumulation of great amounts of this metal, which is highly polluting. In the recent years the increased attention paid to problems concerning environmental protection has made it desirable to manufacture projectiles devoid of parts made of lead, which however, at the same time, are provided with features of high deformability on impact against rigid obstacles.

A further drawback typical of lead projectiles consists in that, due to the weak hardness of the material, projectiles on firing undergo a mechanical abrasive action by the rifling system present on the inner surface of the barrel, which involves removal of small metal amounts. Lead thus removed in the long run causes an accumulation of metal particles in said rifling system, which phenomenon, known as "lead storage" of the barrel, brings about worsening of the firearm performance.

It is a general object of the present invention to obviate the above mentioned drawbacks by providing a projectile having features of high deformability on impact against a rigid obstacle, although it is not made of a particularly soft material such as lead.

SUMMARY OF THE INVENTION

In view of the above object, in accordance with the invention, a projectile for firearms has been devised which comprises a body consisting of a plurality of disc-shaped elements coaxially fitted in a holding cup forcedly filled therewith.

BRIEF DESCRIPTION OF THE DRAWINGS

For better explaining the innovatory principles of the present invention and the advantages it offers over the known art, a possible embodiment thereof applying said principles will be described in the following, by way of non-limiting example, with the aid of the accompanying drawings. In the drawings.

DETAILED DESCRIPTION OF THE INVENTION

With reference to the drawings, a projectile 10 comprises a bullet body 11 having a rear portion 12 of substantially cylindrical shape and a front portion 13 of an ogive-shaped conformation.

Figure 2:
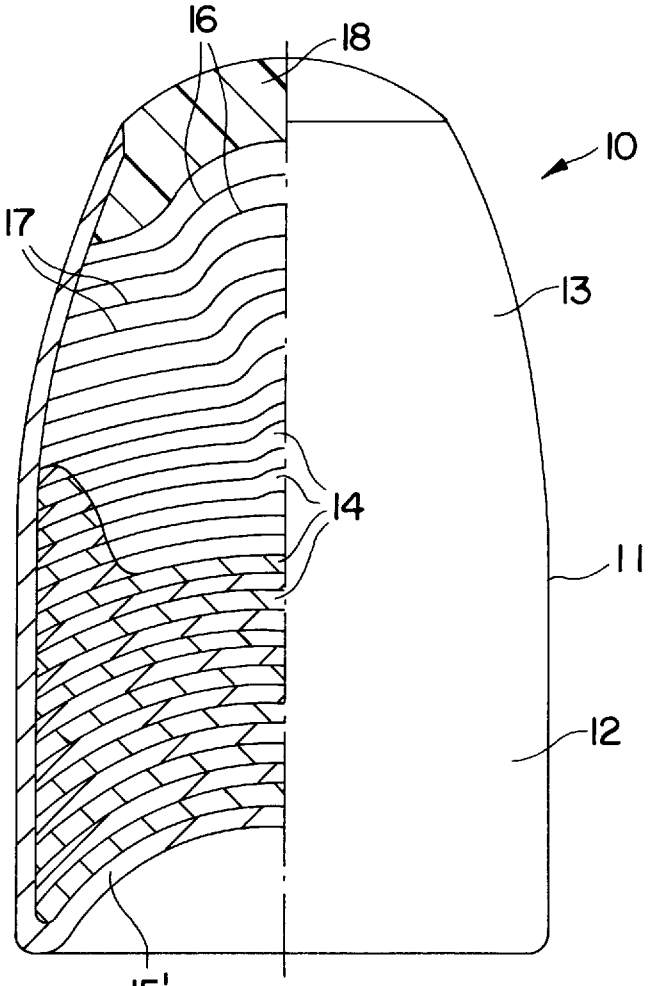
FIG. 2 is a view similar to that in FIG. 1, referred to a finished projectile.
Figure 1:
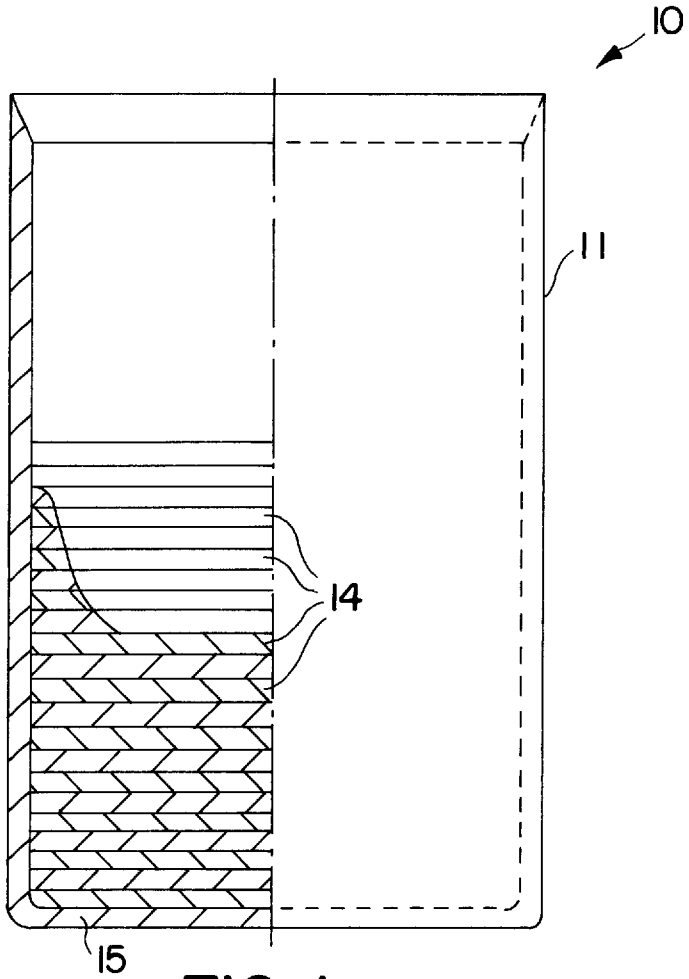
FIG. 1 is a view partly in section of a projectile in accordance with the invention during the step of fitting the disc-shaped elements therein.

According to the invention, body 11 consists of a plurality of disc-shaped elements 14 coaxially fitted in the bore of a holding cup 15 (FIG. 1) which becomes the outer jacket 15' (FIG. 2) of the projectile 10 with elements 14 superposed in an axial direction to the projectile.

For graphic clarity purposes, in the accompanying drawings the disc-shaped elements 14 are shown in section (section lining) only at one portion of the body 11 itself, whereas in the other areas only an outline thereof has been reproduced.

The disc-shaped elements 14, that can be made of thin iron plate for example so as to be deformable by themselves, are advantageously packed within the jacket 15' so that at least one nearly dome-shaped portion thereof has its concavity turned towards the rear part of the projectile in order to increase the packing steadiness.

The iron plate concavity can be obtained before packing of them or, advantageously (as is apparent from a comparison between FIGS. 1 and 2), after packing, during the step of forming the outer jacket 15.

When during the projectile working the cup 15 is given its final shape, the disc-shaped elements 14 disposed in the front portion of the projectile undergo a remarkable curling up towards their center, taking a configuration where the central portions 16 thereof project forwardly relative to the respective peripheral portions 17. This helps in improving cohesion of the disc packing and the ballistic steadiness of the projectile. In addition, the energy absorption features on impact against an obstacle are enhanced.

At the moment of firing and during the flight, the projectile in accordance with the invention ballistically behaves like a traditional projectile.

On impact against a rigid obstacle, due to the innovative configuration of the projectile, the unavoidable deformation or breaking of the disc-holding jacket 15', even if of light value, makes the discs immediately free, so that they can spread all around without causing further damages. Actually, the kinetic energy of the projectile is partly absorbed by the disc deformation and partly shared out into negligible energy amounts transferred to the individual discs being part of said plurality.

It is therefore apparent that a projectile envisaged in accordance with the present invention achieves the intended purposes, i.e. it enables the kinetic energy of the projectile itself to be spread exactly on impact without damages.

In addition, by use of the inventive projectile, environmental damages resulting from employment of lead projectiles are avoided. Finally, since cup 15 can be made of a relatively hard material, there is an enhancement in the sliding features of the projectile along the barrel. Obviously, the above description of an embodiment applying the innovatory principles of the invention is given for purposes of illustration only and is not to be interpreted as a limitation of the scope of the invention as herein claimed.

For example, the disc-shaped elements 14, instead of being of a uniform diameter, can have decreasing diameters towards the front portion of the projectile. In this case, when ogive-like tapering of the cup 15 is carried out, deformation of the front discs shown in the figure will not occur (or will occur to a lower degree). In addition, the disc-shaped elements can optionally have particular conformations adapted to create deformation chambers between pairs of adjacent discs.

Finally, the projectile may be provided with a deformable portion 18 consisting of a rubber or plastic element for example, disposed at the front end of the projectile and covering the disc-shaped elements 14. This portion enables the perforating ability of the projectile to be decreased and makes it easier to cause its disintegration on impact and, in addition, it may represent an element of identification of the projectile type.

What is claimed is:

1. A target-shooting projectile for firearms, comprising a body having a substantially cylindrical shaped rear portion defining the rear end of the projectile, and a coaxial front portion of ogive-shaped configuration defining the front end of the projectile, and a plurality of disc-shaped elements coaxially and forcedly fitted in said body, said elements having curved, coaxially disposed center portions thereof projecting toward one end of said projectile.

2. A projectile as claimed in claim 1, characterized in that the center portions of said disc-shaped elements form thereon concave surfaces that are turned towards the rear end of the projectile.

3. A projectile as claimed in claim 2, characterized in that the center portions of said disc-shaped elements have increasing curvatures towards the front end of the projectile.

4. A projectile as claimed in claim 3, characterized in that as the respective positions of the elements progress towards the front end of the projectile, the center portions of the disc-shaped elements have an increasingly growing depth in the middle thereof for receiving central projections of preceding disc-shaped elements.

5. A projectile as claimed in claim 1, characterized in that the disc-shaped elements are made of deformable thin iron plate.

6. A projectile as claimed in claim 3, characterized in that said plurality of disc-shaped elements have the same diameter on being fitted in said body, the projecting center portions of the disc-shaped elements in said front portion being obtained by reduction of the diameter of the front portion of the body by forming.

7. A projectile as claimed in claim 1, characterized in that it includes a portion of deformable material, disposed at the front end of the projectile and covering the disc-shaped elements.

8. A projectile as claimed in claim 7, characterized in that the deformable portion is made of rubber or plastic material.

* * * * *